US010914022B2

(12) United States Patent
Huang et al.

(10) Patent No.: US 10,914,022 B2
(45) Date of Patent: Feb. 9, 2021

(54) SPIRAL YARN STRUCTURE, MANUFACTURING METHOD AND MANUFACTURING DEVICE THEREOF AND TEXTILE UTILIZING THE SAME

(71) Applicant: CORETEK FIBERS LTD., Taichung (TW)

(72) Inventors: Wen-Chi Huang, Taichung (TW); Ting-Yi Lyu, Taichung (TW)

(73) Assignee: CORETEK FIBERS LTD, Taichung (TW)

( * ) Notice: Subject to any disclaimer, the term of this patent is extended or adjusted under 35 U.S.C. 154(b) by 87 days.

(21) Appl. No.: 16/136,166

(22) Filed: Sep. 19, 2018

(65) Prior Publication Data

US 2019/0085486 A1 Mar. 21, 2019

(30) Foreign Application Priority Data

Sep. 21, 2017 (TW) ..... 106132452 A

(51) Int. Cl.

| | |
|---|---|
| ***D02G 3/38*** | (2006.01) |
| ***D02G 1/02*** | (2006.01) |
| ***D02G 1/14*** | (2006.01) |
| ***D02G 3/04*** | (2006.01) |
| ***D02G 3/26*** | (2006.01) |

(52) U.S. Cl.

CPC ..... *D02G 3/38* (2013.01); *D02G 1/028* (2013.01); *D02G 1/14* (2013.01); *D02G 3/04* (2013.01); *D02G 3/26* (2013.01); *D10B 2201/02* (2013.01); *D10B 2201/20* (2013.01); *D10B 2211/02* (2013.01); *D10B 2211/04* (2013.01); *D10B 2331/02* (2013.01); *D10B 2331/04* (2013.01)

(58) Field of Classification Search

CPC ..... D01H 1/02; D01H 1/025; D01H 1/162; D01H 7/52; D01H 13/04

See application file for complete search history.

(56) References Cited

U.S. PATENT DOCUMENTS 3,276,196 A * 10/1966 Hans-Rudolf ..... D01H 13/04 57/328
3,350,867 A * 11/1967 Morrison ..... D01H 5/36 57/12

(Continued)

FOREIGN PATENT DOCUMENTS

FR 1193060 A * 10/1959 ..... D02G 3/38
FR 1347903 A * 1/1964 ..... D01D 5/00

OTHER PUBLICATIONS

English language translation of FR1193060, obtained via espacenet.com, last visited Apr. 30, 2020.*

*Primary Examiner* — Shaun R Hurley
*Assistant Examiner* — Patrick J. Lynch

(57) ABSTRACT

A spiral yarn structure includes a core yarn comprising at least one core filament which is a filament fiber of 5-25D, a cover yarn comprising a plurality of cover fibers formed by stretching roves having a count ranging from 0.5 Ne to 2.0 Ne, wherein the cover fibers encloses the core yarn, and a wrap yarn wrapping the cover yarn at a twist factor K≤3, wherein the wrap yarn comprises at least one wrap filament which is a filament fiber of 5-25D, and the at least one wrap filament wraps an outer side of the cover yarn at an inclined angle to form the spiral yarn structure having a count ranging from 40 Ne to 80 Ne.

2 Claims, 8 Drawing Sheets

(56) References Cited

U.S. PATENT DOCUMENTS

| | | | | |
|---|---|---|---|---|
| 4,489,540 | A * | 12/1984 | Faure | D02G 3/367 57/328 |
| 5,531,063 | A * | 7/1996 | Sawhney | D01H 13/04 19/244 |
| 10,704,168 | B2 * | 7/2020 | Yenici | D02G 3/32 |
| 2008/0318485 | A1 * | 12/2008 | Cheng | D03D 15/08 442/182 |
| 2015/0184319 | A1 * | 7/2015 | Yeung | D02G 3/367 428/221 |
| 2015/0354101 | A1 * | 12/2015 | Liao | D03D 15/08 442/182 |
| 2019/0055678 | A1 * | 2/2019 | Hightower, III | D02G 3/441 |

* cited by examiner

SPIRAL YARN STRUCTURE, MANUFACTURING METHOD AND MANUFACTURING DEVICE THEREOF AND TEXTILE UTILIZING THE SAME

BACKGROUND OF THE INVENTION

Field of the Invention

The invention relates to a spiral yarn structure, a manufacturing method and a manufacturing device thereof and a textile using the spiral yarn structure, and more particularly to a spiral yarn structure including a core yarn enclosed by a cover yarn formed by staple fibers and a wrap yarn wrapping the cover yarn, wherein the spiral yarn of the invention has smaller twist and torque, and shrinkage, torque and skew of fabric formed by the spiral yarn are thus reduced.

Description of the Related Art

Accordingly, vertical stripes, horizontal stripes or checkered stripes formed by vertical stripes and horizontal stripes are formed to enhance aesthetic of the cloth. Due to mechanical limitations of loom/knit machines or torque generated in twisted yarns used for fabric, thin and light-weighted textile made of the yarns formed by cotton, cellulose or other non-thermoset material may have a shrinkage up to 8%-15%, their torque is difficult to be controlled under 3% and their skew may also be 25-30%. This causes post processing problems for the textile and shrinkage problem for cloth made of the textile.

To solve the problems, elastomeric yarns (Spandex) of 20D are woven/knitted to textile. Although the shrinkage and torque problems are improved slightly, however the skew is still 25-30% (as shown in FIG. 7). The elastomeric yarns may increase total weight of the cloth and possibly cause uneven quality of the cloth. Since the tensionused in cloth winding may even cause unstable occurrence of shrinkage and torque, the cloth must be loosen and pre-shrunk (washed by water) before the cloth is cut, thereby avoiding the shrinkage and torque problem. Such post-processes for cloth products cause more labors and troubles.

BRIEF SUMMARY OF THE INVENTION

The present invention provides a spiral yarn. The spiral yarns as weft yarns are knitted to form knitted fabric, or the spiral yarns as weft yarns and wrap yarns are woven to form woven fabric. Since the spiral yarns have smaller twist and low torque, the shrinkage, torque and skew of textile made of the spiral yarns are thus reduced, but the strength is increased at the same yarn count. The spiral yarns of the present invention can also reduce the occurrence of broken yarns.

The present invention provides a spiral yarn. The spiral yarn in accordance with an exemplary embodiment of the present invention includes a core yarn including at least one core filament which is a filament fiber of 5-25D, a cover yarn including a plurality of cover fibers formed by stretching roves having a count ranging from (0.5 Ne to 2.0 Ne, wherein the cover fibers enclose the core filament, and a wrap filament wrapping the cover fiber at a twist factor $K \leq 3$, wherein the wrap yarn comprises at least one wrap filament which is a filament fiber of 5-25D, and the at least one wrap filament wraps an outer side of the cover fiber at an inclined angle to form the spiral yarn structure having a count ranging from 40 Ne to 80 Ne.

The present invention also provides a textile formed by the spiral yarn of the present invention. The textile is a knitted fabric having the spiral yarn structure as a weft yarn, or textile is a woven fabrics having the spiral yarn structure as a weft yarn and a warp yarn. The cover fibers formed by staple fibers enclose the core filament, and the wrap filament wraps the cover fiber and the staple fibers of the cover fiber so that the spiral yarn has lower twist and torque, and the shrinkage, the torque and the skew of the textile formed by the spiral yarns of the present invention are thus reduced.

The present invention also provides a manufacturing device which is a ring spinning machine. The manufacturing device in accordance with an exemplary embodiment of the present invention includes a drafting assembly, a guiding wheel and a twister. The drafting assembly includes a front roller comprising an upper roller and a lower roller, a middle roller, and a rear roller. The guiding wheel is disposed above the front roller, wherein the guiding wheel includes a first guiding groove and a second guiding groove configured to feed a core yarn and a wrap yarn into a space between the upper roller and the lower roller.

The present invention also provides a manufacturing method for manufacturing the spiral yarn of the present invention. The manufacturing method in accordance with an exemplary embodiment of the present invention includes the following steps: drafting roves to form the cover fiber through a drafting assembly; feeding the core filament and the wrap filament into the drafting assembly through a guiding wheel so that the core filament and the wrap filament are fed into a space between an upper roller and a lower roller of the drafting assembly and run on two sides of the cover fiber respectively; and twisting the core filament, the cover fiber and the wrap filament through a twister to form the spiral yarn in such a manner that the cover fibers enclose the core filament and the wrap filament wraps the outer side of the cover fiber.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
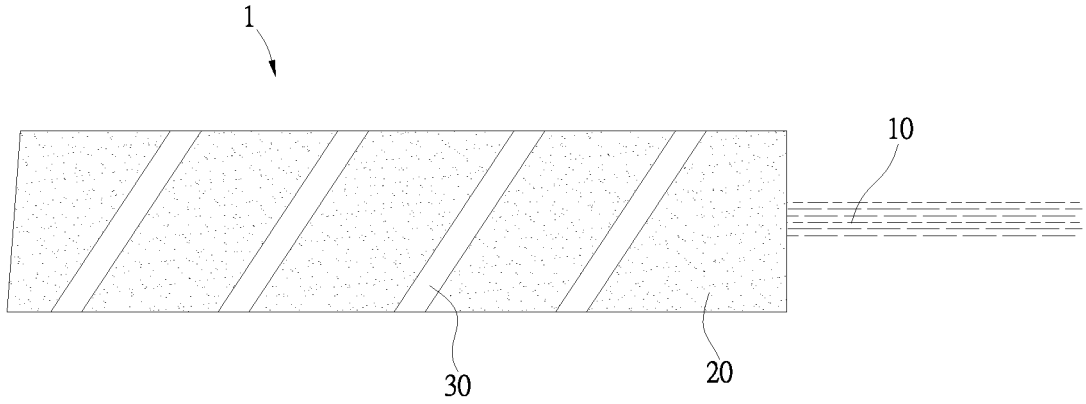
FIG. 1 is a schematic view of an embodiment of a spiral yarn structure of the present invention.
Figure 2:
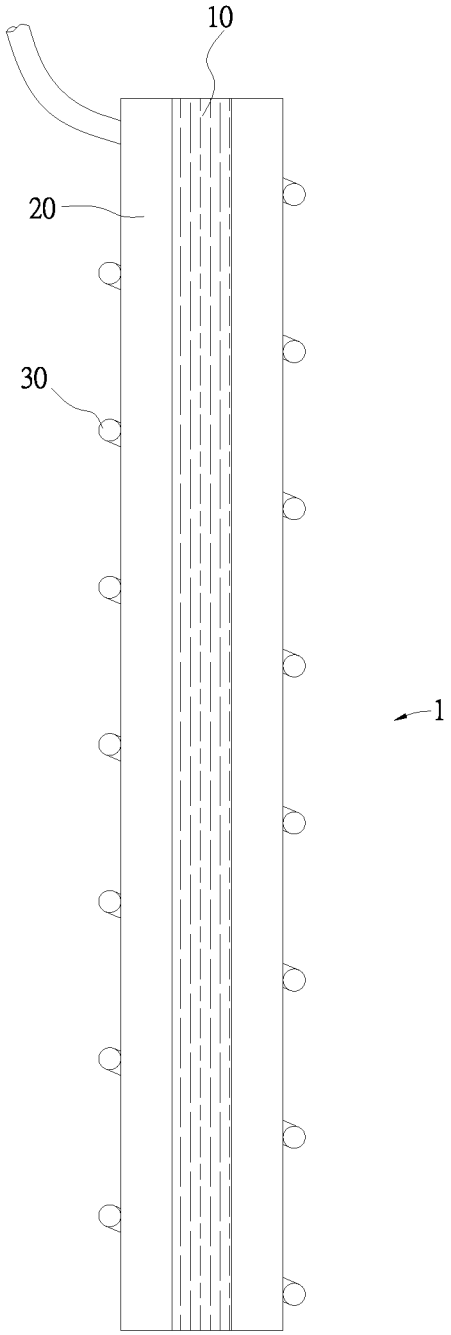
FIG. 2 is a longitudinal cross-sectional view of an embodiment of a spiral yarn structure of the present invention.
Figure 3:
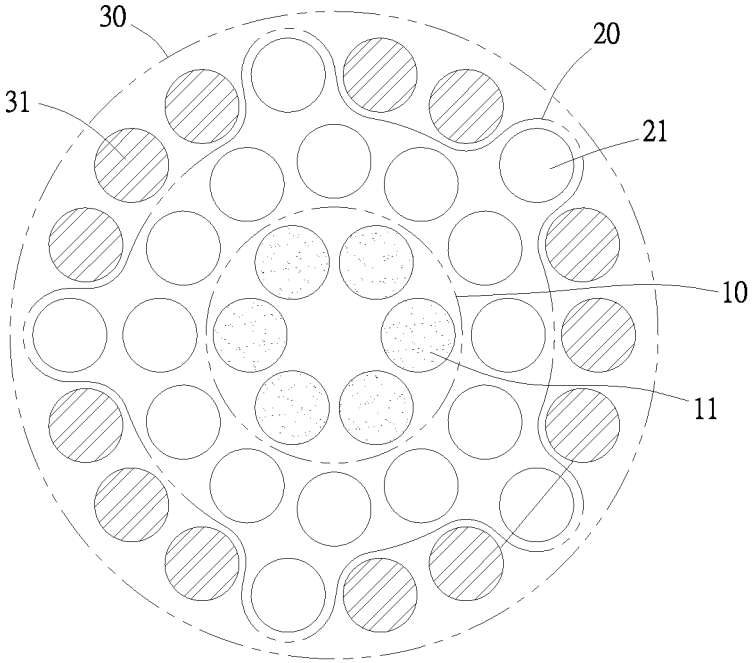
FIG. 3 is a transverse cross-sectional view of an embodiment of a spiral yarn structure of the present invention.

Referring to FIGS. 1, 2 and 3, a spiral yarn 1 of the present includes a core yarn 10, a cover yarn 20 enclosing the core yarn 10 and a wrap yarn 30 wrapping the cover yarn 10 at a twist factor K≤3. The wrap yarn 30 wraps an outer side of the cover yarn 20 to form the spiral yarn 1 having a count ranging from 40 Ne to 80 Ne. The twist direction of the spiral yarn 1 is Z-twist or S-twist. In this embodiment, the twist direction of the spiral yarn 1 is Z-twist, but one of the core yarn and the wrap yarn has a twist direction of S-twist which is different from the twist direction of the spiral yarn 1.

The core yarn 10 includes at least one core filament 11 which is a filament fiber having fineness ranging from 5D to 25D and is non-twisted or S-twisted. In this embodiment, the core filament 11 is polyamide fiber or polyester fiber.

The cover yarn 20 includes a plurality of cover fibers 21 which are formed by drafting and twisting roves which have a count ranging from 0.5 Ne to 2.0 Ne. The cover fibers 21 enclose the core yarn 10. In this embodiment, the cover fiber 21 is a staple fiber, and the cover fiber 21 is cotton, cellulose, wool, silk, polyester or acrylic fibers.

The wrap yarn 30 includes at least one wrap filament 31. The wrap filament 31 wraps the cover fibers 21. The wrap filament 31 has a twist direction of Z-twist which is different from the twist direction of the core filament 11. The wrap filament 31 is a filament fiber having fineness ranging from 5D to 25D. In this embodiment, the wrap filament 31 is a polyamide fiber or polyester fiber. In another embodiment, the wrap filament 31 includes cotton, cellulose, wool, polyester or acrylic fibers, and furthermore the wrap filament 31 is any synthetic filament yarn or staple fiber having a main composition of cotton, cellulose, wool, polyester or acrylic-fibers.

Figure 4:
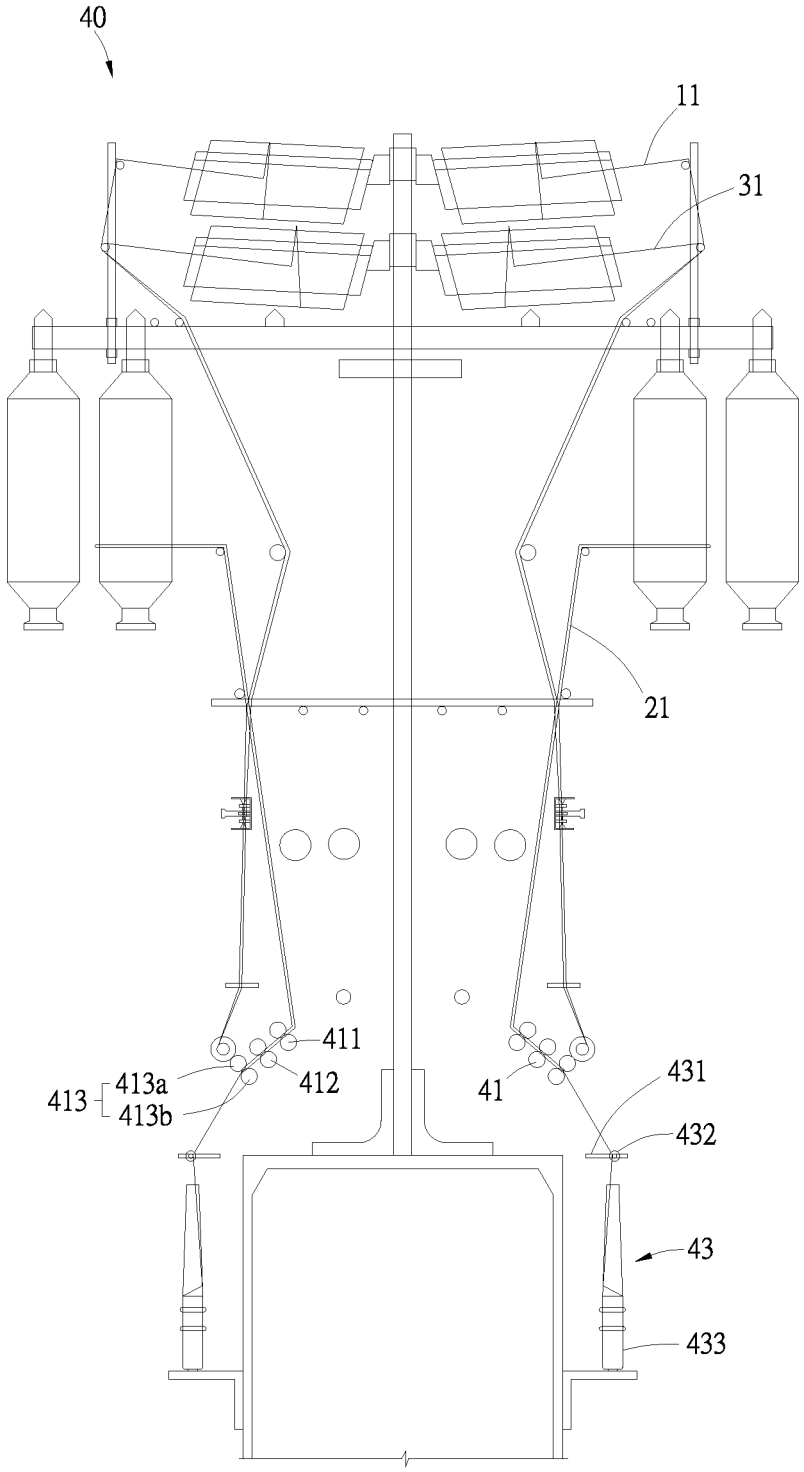
FIG. 4 is a schematic view of a ring spinning machine manufacturing the spiral yarns of the present invention.
Figure 5:
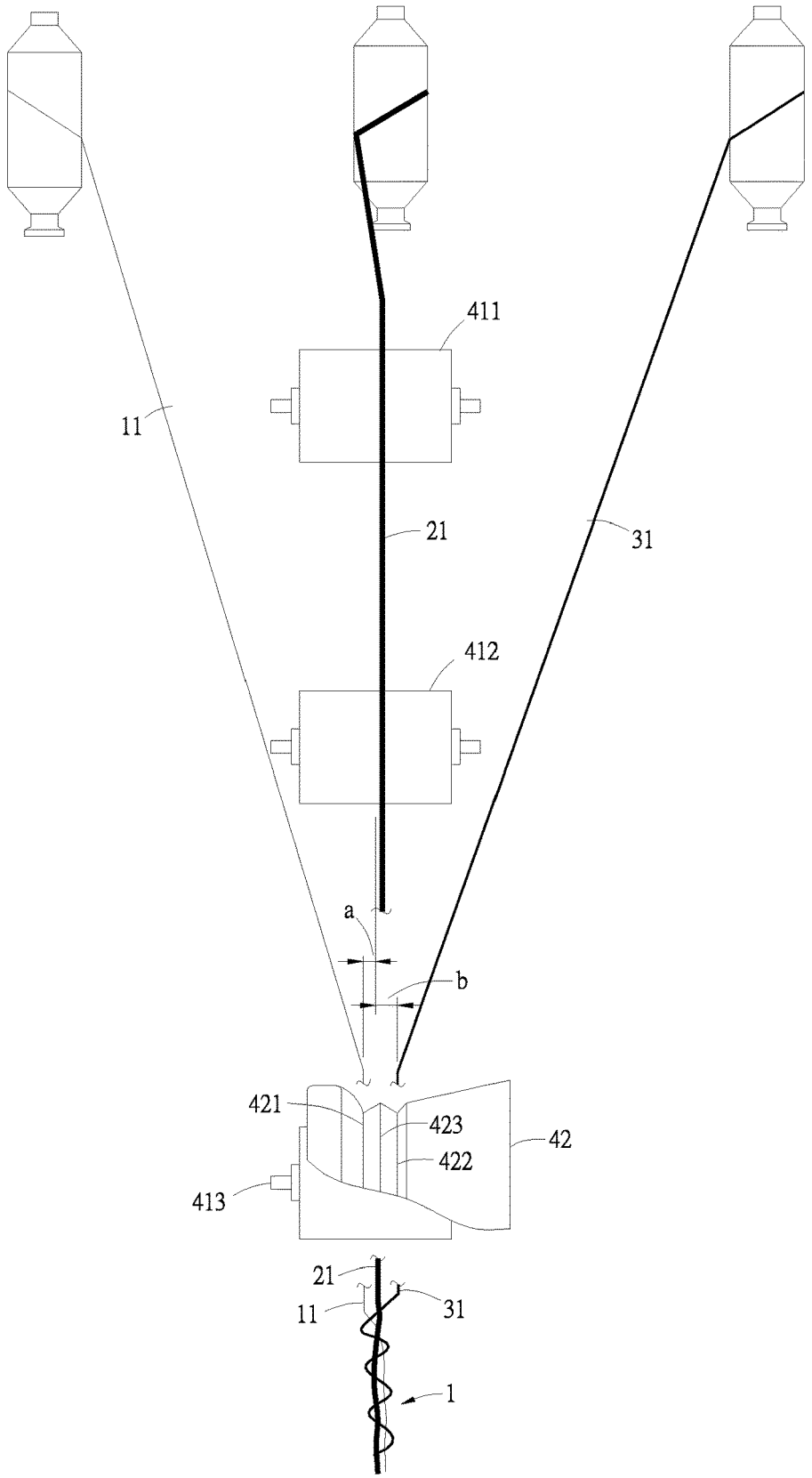
FIG. 5 is a partially enlarged view of the ring spinning machine manufacturing the spiral yarns of the present invention.

Referring to FIGS. 4 and 5, a manufacturing device of the spiral yarn structure of the present invention is illustrated. The manufacturing device is a ring spinning machine 40. The ring spinning machine 40 includes a drafting assembly 41, a guiding wheel 42 and a twister 43.

The drafting assembly 41 includes a rear roller 411, a middle roller 412 and a front roller 413. The front roller 413 includes an upper roller 413*a* and a lower roller 413*b*.

The guiding wheel 42 is disposed above the upper roller 413*a*. A first guiding groove 421 and a second guiding groove 422 are formed on the guiding wheel 42. The first guiding groove 421 and the second guiding groove 422 have V-shaped cross sections. A separating rib 423 is disposed between the first guiding groove 421 and the second guiding groove 422. The first guiding groove 421 and the second guiding groove 422 are located on two opposite sides of a central line of the drafting assembly 41. A distance a between a central line on a bottom of the first guiding groove 421 and the central line of the drafting assembly 41 is shorter than a distance h between a central line on a bottom of the second guiding groove 422 and the central line of the drafting assembly 41.

The twister 43 is disposed under the drafting assembly 41. The twister 43 includes a ring 431 and a traveler 432 disposed on the ring 431.

The rove formed by cotton, cellulose, wool, silk, polyester or acrylic staple fibers are drafted by the rear roller 411, the middle roller 412 and the front roller 413 sequentially to form the cover fiber 21. The core filament 11 and the wrap filament 31 are guided by the first guiding groove 421 and the second guiding groove 422 respectively. The core filament 11 and the wrap filament 31 run under the guiding wheel 42 and fed into the opposite sides of the cover fiber 21 in the space between the upper roller 413*a* and the lower roller 413*b* so that the core filament 11, the wrap filament 31 and the cover fiber 21 run through the traveler 432 on the ring 431 and finally wrap around the ring bobbin 433. When the traveler 432 rotates due to the wrapping, the core filament 11, the wrap filament 31 and the cover fiber 21 are twisted to form the spiral yarn 1 at a twist factor K≤3, wherein the cover fibers 21 enclose the core filament 11, and the wrap filament 31 wraps the cover fiber 21 at a spiral manner.

Figure 6:
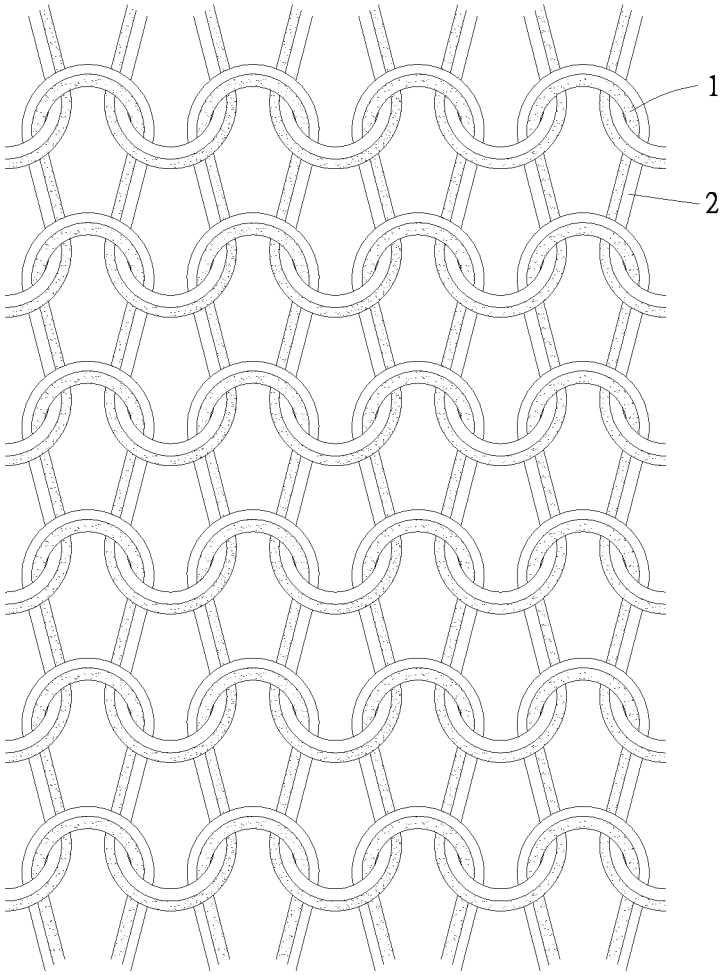
FIG. 6 is a schematic view of textile made of the spiral yarns of the present invention.
Figure 7:
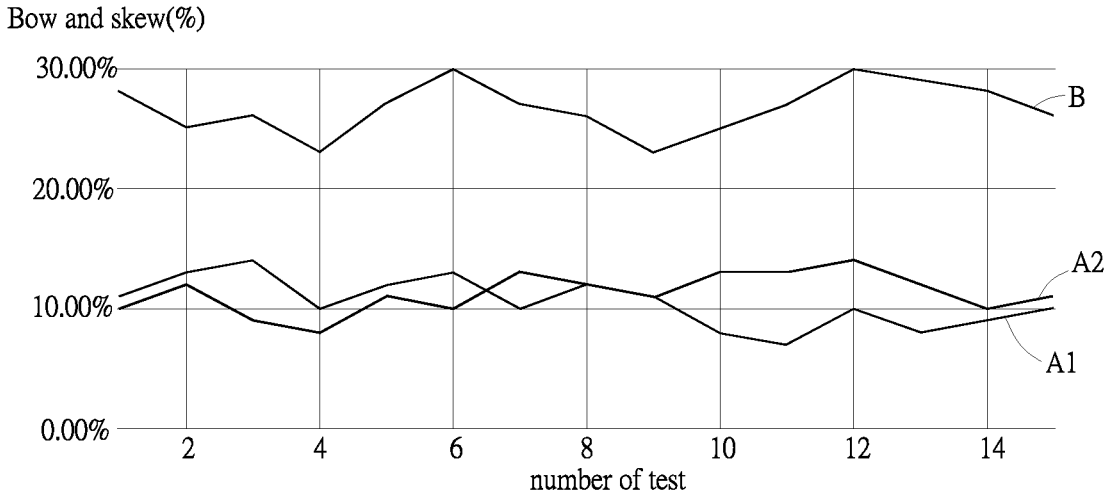
FIGS. 7 and 8 depict skew comparison of conventional yarns and the spiral yarn of the present invention.

Referring to FIG. 6, a textile formed by the spiral yarns of the present invention is illustrated. In this embodiment, the spiral yarn 1 includes the cover fibers 21 formed by cotton rove having a count of 2.0 Ne, the core filament 11 formed by Nylon filament having fiber fineness of 20D and the wrap filament 31. The cover fibers 21, the core filament 11 and the wrap filament 31 are combined and twisted at a twist factor K=2.5 to form the spiral yarn 1 having a count of 60 Ne. The spiral yarns 1 of 60 Ne and elastomeric yarns (Spandex) 2 of 20D serving as knit yarns are fed for weft knit and thus from elastic knitted fabric. The skew test result of elastic knitted fabrics is shown in FIG. 7. The curve A1 represents skew values of the elastic knitted fabric formed by the spiral yarns 1 of 60 Ne and the elastomeric yarns (Spandex) 2 of 20D, which has an average skew of 9.87%. The curve A2 represents skew values of another elastic knitted fabric formed by weft knitting the spiral yarn 1 of 80 Ne and the elastomeric yarns (Spandex) 2 of 20 D at a twist factor K=3, which has an average skew of 11.93%. The curve B represents skew values of another elastic knitted fabric formed by knitting cotton yarn of 60 Ne and the elastomeric yarns (Spandex) 2 of 20D, which has an average skew of 26.67%. It is clear that the skew of the fabric formed by the spiral yarn 1 of the present invention is reduced remarkably, and the fabric loss in the cloth manufacturing process due to skew is also reduced.

Figure 8:
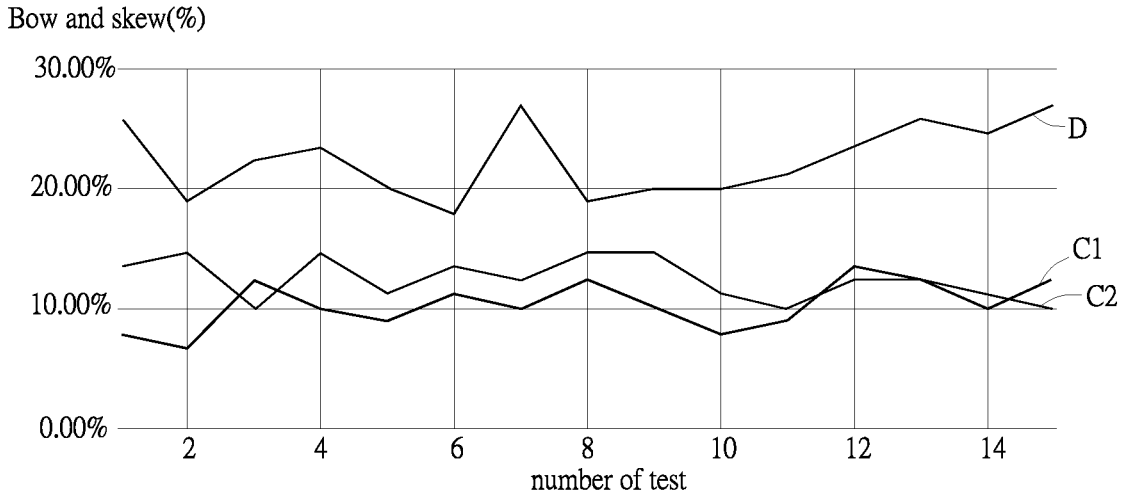

Referring to FIG. 8, a skew test result of a textile formed by the spiral yarn of the present invention is illustrated. The curve C1 represents skew values of a knitted fabric formed by weft knitting the spiral yarns 1 at a twist factor K=2.5, wherein the spiral yarn 1 includes the cover fiber 21 formed by roves of 1.5 Ne, the core filament 11 and the wrap filament 31 formed by Nylon filaments having fiber fineness of 20D. The knitted fabric represented by the curve C1 has an average skew of 10.2%. The curve C2 represents skew values of a knitted fabric formed by weft knitting the spiral yarns 1 at a twist factor K=3, wherein the spiral yarn 1 includes the cover fiber 21 formed by roves of 2.0 Ne, the core filament 11 and the wrap filament 31 formed by Nylon filaments having fiber fineness of 20D. The knitted fabric represented by the curve C2 has an average skew of 11.93%. The curve D represents skew values of a knitted fabric formed by knitting cotton yarns. The knitted fabric represented by the curve D has an average skew of 22.07%. It is clear that the skew of the fabric formed by the spiral yarn 1 of the present invention is reduced remarkably, and the fabric loss in the cloth manufacturing process due to skew is also reduced.

The spiral yarn of the present invention utilizes the cover fiber formed by staple fibers to enclose the core filament, and utilizes the wrap filament to wrap the cover fiber and the staple fibers of the cover fiber so that the spiral yarn has lower twist and torque. The twist direction of the wrap filament is different from the twist direction of the core filament so that the shrinkage, the torque and the skew are thus reduced.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A manufacturing device for manufacturing a spiral yarn, comprising:

a drafting assembly comprising:

a front roller comprising an upper roller and a lower roller;

a middle roller; and a rear roller, wherein a rover is drafted by the front roller, the middle roller and the rear roller to form a cover yarn;

a guiding wheel disposed directly on the front roller, wherein the guiding wheel comprises a first guiding groove and a second guiding groove configured to feed a core yarn and a wrap yarn into a space between the upper roller and the lower roller, and a center of the guiding wheel is located in a line extending through a center of the upper roller and a center of the lower roller; and a twister comprising a ring and a traveler disposed on the ring;

wherein the first guiding groove and the second guiding groove are located on two sides of a central line of the drafting assembly, a distance between a central line of a bottom of the first guiding groove to the central line of the drafting assembly is smaller than a distance between a central line of a bottom of the second guiding groove to the central line of the drafting assembly;

wherein the core yarn and the wrap yarn run on the guiding wheel and are fed into opposite sides of the cover yarn in the space between the upper roller and the lower roller so that the core yarn, the cover yarn and the wrap yarn run through the ring and the traveler, when the traveler rotates due to the wrapping, the core filament, the wrap filament and the cover fiber are twisted to form the spiral yarn, wherein the cover fibers enclose the core filament, and the wrap filament wraps the cover fiber at an inclined angle and a spiral manner to form a spiral yarn.

2. The manufacturing device as claimed in claim 1, wherein the first guiding groove and the second guiding groove are V-shaped.

* * * * *